United States Patent [19]

Howard

[11] 3,982,055

[45] Sept. 21, 1976

[54] METHOD FOR ZINCATING ALUMINUM ARTICLES

[75] Inventor: Addison M. Howard, Exton, Pa.

[73] Assignee: Eltra Corporation, Toledo, Ohio

[22] Filed: July 25, 1974

[21] Appl. No.: 491,700

[52] U.S. Cl. ..... 427/309; 427/328; 427/345; 427/436; 148/6.27; 106/1

[51] Int. Cl.[2] ..... C23C 3/00

[58] Field of Search ..... 106/1; 148/6.27; 427/321, 433, 436, 309, 328, 345

[56] References Cited

UNITED STATES PATENTS

| | | | |
|---|---|---|---|
| 2,650,886 | 9/1953 | Zelley | 106/1 |
| 3,216,835 | 11/1965 | Saubestre | 106/1 |
| 3,235,404 | 2/1966 | Mickelson et al. | 106/1 |
| 3,329,522 | 7/1967 | Saubestre et al. | 148/6.27 |
| 3,532,519 | 10/1970 | Hirohata et al. | 106/1 |

*Primary Examiner*—Lorenzo B. Hayes
*Attorney, Agent, or Firm*—John C. Purdue

[57] ABSTRACT

A method for preparing aluminum or aluminum alloy bodies to receive an electrically deposited surface coating is disclosed. The method includes degreasing the body, if necessary, etch cleaning and zinc coating the body, washing and drying the etch cleaned and zinc-coated body, etching the dried body in 40° Baume nitric acid or, when the body is an alloy of aluminum containing as much as about 2 percent of silicon, in 40° Baume nitric acid which also contains from 1½ to 3 percent of ammonium bifluoride, washing the etched body in cold running water, zincating the washed body and washing the zincated body in cold running water. The baths used in the various steps of the method of the invention and the times and temperatures used, are set forth in the following Table wherein percentages are by weight:

| STEP | BATH | TEMPERATURE | TIME OF STEP |
|---|---|---|---|
| Etch cleaning and zinc-coating | Aqueous sodium hydroxide, 1.3 to 2.7 normal, also containing 1¼ to 3 percent of tetrasodium salt of ethylenediamine tetra-acetic acid and from 0.05 to 0.15 percent of zinc oxide | 170–190°F. | 5–10 seconds |
| Etching | — | Up to about 110°F. | 2–5 seconds |
| Zincating | Aqueous sodium hydroxide, 2½ to 5 normal, also containing 5 to 18 percent of tetrasodium salt of ethylenediamine tetra-acetic acid and 0.4 to 2.5 percent of zinc, calculated as Zn | 120–160°F. | ½–5 seconds |

2 Claims, No Drawings

METHOD FOR ZINCATING ALUMINUM ARTICLES

BACKGROUND OF THE INVENTION

Various expedients have been suggested to overcome the difficulties involved in electroplating on aluminum and aluminum alloys, which difficulties are caused by the rapidity with which an oxide film forms on the surfaces of aluminum and aluminum alloy bodies which are exposed to air. The present invention is concerned with an improved method for preparing an aluminum or aluminum alloy body to receive an electrically deposited surface coating by a method which includes the treatment of the body in an alkaline displacement solution, more specifically, in a zincate solution. Zincate solutions, and their use, are known, being disclosed, for example, in U.S. Pat. No. 3,216,835 and in German Pat. No. 731,102.

BRIEF DESCRIPTION OF THE INVENTION

The instant invention is based upon the discovery of an improved method for preparing an aluminum-containing body, i.e., an aluminum body or an aluminum alloy body, to receive an electrically deposited surface coating. The surfaces of the aluminum-containing body must be essentially free of grease to be prepared in accordance with the invention; accordingly, unless the surfaces are essentially grease-free, as received, they should be preliminarily de-greased, for example in a vapor phase de-greaser, using an inhibited, chlorinated solvent. The body, either as received, or after de-greasing, is first etch cleaned and zinc coated, followed by washing and drying steps. The dried body is then etched in 40° Baume nitric acid or, when the body is a silicon alloy of aluminum containing about 2 percent or more of silicon, in 40° Baume nitric acid which also contains from 1-½ to 3 percent of ammonium bifluoride. The etched body is then washed in cold running water, zincated and finally washed again in cold running water. As a consequence of using baths and controlling time and temperature of treatment as set forth in the foregoing Table for the steps of etch cleaning and zinc-coating, of etching, and of zincating, the method of the instant invention is unexpectedly advantageous by comparison with all previously known zincating methods. The advantage of the method of the instant invention resides in extremely short treating times, which enable high speed, continuous zincating in small tanks requiring only small quantities of the treating baths.

DESCRIPTION OF PREFERRED EMBODIMENT

The following Example wherein, as elsewhere herein, including the appended claims, the terms "percent" and "parts" refer to percent and parts by weight, unless otherwise indicated, illustrates the preferred embodiment of the invention, constituting the best presently known mode.

EXAMPLE 1

Three baths, one for etch cleaning and zinc-coating, one for etching, and one for zincating, were prepared. The chemical composition of each bath, the length of the container in which each bath was used, and the control temperature for each bath are given in the following Table:

| BATH | COMPOSITION | TEMPERATURE | LENGTH OF BATH CONTAINER |
|---|---|---|---|
| Etch cleaning and zinc-coating | Aqueous sodium hydroxide, 2 normal, also containing 2 percent of tetrasodium salt of ethylenediamine tetraacetic acid and 0.1 percent of zinc oxide | 180°F. | 10 feet |
| Etching | 40° Baume nitric acid | Ambient, about 70°F. | 5 feet |
| Zincating | Aqueous sodium hydroxide, 4 normal, also containing 10 percent of tetrasodium salt of ethylenediamine tetraacetic acid and 1½ percent of zinc, calculated as Zn. | 140°F. | 1 foot |

Aluminum wire having a diameter of about 0.1 inch and a substantially grease-free exterior surface was prepared to receive an electrically deposited coating by passing it at a rate of 100 feet per minute through the etch cleaning and zinc-coating bath then, after a spray rinse with cold water and an air-wipe to remove excess water, through the etching bath and, finally, after a second spray rinse with cold water and second air-wipe, through the zincating bath. The zincated wire was washed with cold running water immediately after it exited the zincating bath, and was then ready to receive an electrically deposited coating, for example an electroplated coating applied by conventional means. The wire was examined and was found to have a zinc coating ranging from about 0.06 to 0.08 milligram per square inch, and to be continuous and tightly adhered to the aluminum.

During operation, as just described, to apply a zinc coating to aluminum wire, the sodium hydroxide content of the zincating bath was monitored, and additions were made to maintain the bath 4 normal in sodium hydroxide. For this purpose, the following mixture was added to the zincating bath: sodium hydroxide 50 percent; tetrasodium salt of ethylenediamine tetraacetic acid 40 percent; zinc acetate 10 percent.

The disclosed and claimed process provides a method for consistently applying an adherent zinc coating to aluminum and aluminum alloys. The aluminum can be alloyed with metals such as Si, Fe, Cu, Mn, Mg, Cr, Ni, Zn, Ti and Sn, depending upon the properties desired. For example, the 1972 SAE Handbook describes compositional limits and physical properties of more than 30 aluminum casting alloys. The minimum aluminum content of alloys coated according to the invention is about 75 percent, the remainder being one or more of the metals identified above.

Various processes are known in the prior art for preparing aluminum and aluminum alloys for electroplating. However, many of these processes suffer from disadvantages such as requiring low plating speed and a long immersion time, a concentrated alkaline solution, a plurality of plating tanks, and different pretreatments for different aluminum alloys. Other processes require a "double zincate" treatment wherein the aluminum article is cleaned, acid dipped, zinc coated, and the process repeated.

The instant process uses a heated dilute alkaline solution of sodium zincate and a chelating agent. Experimental test results indicate that the concentration of the alkaline solution should be maintained at a normality from 1.3 to 2.7; the zincating bath should contain from 1 and ¼ to 3 percent by weight of the sodium salt of ethylenediamine tetraacetic acid. The bath should be maintained at a temperature within the range of from 170° to 190°F. Use of a first etch cleaning bath which contains zinc ions gives the process the advantage of the "double zincate" process, and at the same time eliminates the necessity for extra plating tanks. The zincating process as disclosed and claimed makes coating at 100 feet per minute possible, using an etch cleaning and zinc-coating tank 10 feet long, an acid treating tank 5 feet long, a zincating tank 1 foot long and associated rinse tanks.

What I claim is:

1. A method for preparing an aluminum-containing body having substantially grease-free surfaces to receive an electrically deposited surface coating, which method includes the steps of etch cleaning and zinc-coating the body by immersion thereof for from 5 to 10 seconds in an aqueous sodium hydroxide bath ranging in normality from 1.3 to 2.7, and maintained at a temperature from 170° to 190°F., said bath also containing from 1-¼ to 3 percent of the tetrasodium salt of ethylenediamine tetraacetic acid and from 0.05 to 0.15 percent of zinc oxide, washing the etch cleaned and zinc-coated body, drying the washed body by removing wash water therefrom, etching the dried body in 40° Be nitric acid at a temperature not higher than about 110°F. for from 2 to 5 seconds, with the proviso that, when the body is an alloy containing as much as 2 percent of silicon, the nitric acid also contains from 1-½ to 3 percent of ammonium bifluoride, washing the etched body in cold running water, zincating the washed body by immersion thereof for from ½ second to 5 seconds in an aqueous bath maintained at a temperature from 120° to 160°F., said bath consisting of sodium hydroxide ranging in normality from 2-½ to 5, from 5 to 18 percent of the tetrasodium salt of ethylenediamine tetraacetic acid and from 0.4 to 2.5 percent of zinc, calculated as the metal, and washing the zincated body in cold running water.

2. A method as claimed in claim 1 wherein the sodium hydroxide content of the zincating bath is monitored periodically and maintained within the recited range by adding to the bath a composition composed of sodium hydroxide, 50 percent, tetrasodium salt of ethylenediamine tetraacetic acid, 40 percent, and zinc acetate, 10 percent.

* * * * *